US008376785B2

(12) United States Patent
Lapidot et al.

(10) Patent No.: US 8,376,785 B2
(45) Date of Patent: Feb. 19, 2013

(54) ELECTRICAL CONNECTOR

(75) Inventors: Doron Lapidot, Tokyo (JP); Zhiqiang Li, Shanghai (CN); Huibin Li, Shanghai (CN)

(73) Assignees: Tyco Electronics Japan G.K., Kanagawa-Ken (JP); Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 13/179,016

(22) Filed: Jul. 8, 2011

(65) Prior Publication Data

US 2012/0009823 A1 Jan. 12, 2012

(30) Foreign Application Priority Data

Jul. 8, 2010 (CN) ..... 2010 1 0225191

(51) Int. Cl.
*H01R 24/00* (2006.01)

(52) U.S. Cl. ..... 439/660; 439/626; 439/60; 439/924.1; 439/941

(58) Field of Classification Search ..... 439/660
See application file for complete search history.

(56) References Cited

U.S. PATENT DOCUMENTS

| | | | | |
|---|---|---|---|---|
| 6,196,880 | B1 | 3/2001 | Goodrich | |
| 6,863,549 | B2 * | 3/2005 | Brunker et al. | 439/108 |
| 8,002,572 | B2 * | 8/2011 | Lu et al. | 439/405 |
| 8,162,671 | B2 * | 4/2012 | Matsubara et al. | 439/60 |
| 2004/0121633 | A1 * | 6/2004 | David et al. | 439/108 |
| 2011/0070751 | A1 * | 3/2011 | Lee | 439/83 |
| 2011/0306239 | A1 * | 12/2011 | Zhang et al. | 439/607.01 |
| 2012/0009823 | A1 * | 1/2012 | Lapidot et al. | 439/626 |

FOREIGN PATENT DOCUMENTS

| | | | |
|---|---|---|---|
| CN | 201336479 | Y | 10/2009 |
| CN | 201355727 | Y | 12/2009 |
| CN | 201397992 | Y | 2/2010 |
| CN | 201498831 | U | 6/2010 |

* cited by examiner

*Primary Examiner* — James Harvey
(74) *Attorney, Agent, or Firm* — Barley Snyder

(57) ABSTRACT

An electrical connector having an insulative housing, a plurality of first terminals and a plurality of second terminals. The first terminals are disposed in the insulative housing. Each of the first terminals has a first contact portion, a first solder portion, and a first connection portion between the first contact portion and the first solder portion. The plurality of second terminals are also disposed in the insulative housing. Each of the second terminals has a second contact portion, a second solder portion, and a second connection portion between the second contact portion and the second solder portion. The first solder portions of the first terminals and the second solder portions of the second terminals are arranged in two rows in a lateral direction, respectively. The row of the first solder portions is separated from the row of the second solder portions by a predetermined distance in a longitudinal direction.

28 Claims, 6 Drawing Sheets

ELECTRICAL CONNECTOR

CROSS-REFERENCE TO RELATED APPLICATION

This application claims the benefit of the filing date under 35 U.S.C. §119(a)-(d) of Chinese Patent Application No. 2010-10225191.3 filed on Jul. 8, 2010 in the State Intellectual Property Office of China.

FIELD OF THE INVENTION

The invention relates to an electrical connector, and, more particularly, relates to a high speed signal electrical connector.

BACKGROUND

Well known electrical connectors are used to provide a power connection and/or a signal connection between electronic equipment. Generally, space restrictions require such electrical connectors to have a plurality closely spaced terminals. Therefore, creating a tendency for crosstalk between adjacent terminals and disadvantageously affecting signals transmitted through the terminals.

USB (Universal Serial Bus) is a communication standard, which has been updated from a conventional USB2.0 standard to a current USB3.0 standard. Accordingly the transmission speed thereof has been increased from 480 Mbit/s to 5 Gbit/s. The USB3.0 standard has very rigorous requirements for the structural design and the electrical performance especially with respect to the electrical connector interface for transmitting super speed signals.

FIG. 9 shows a conventional USB3.0 connector having a first group of terminals 811, 812, 813 and a second group of terminals 920, 281, 923.

As shown in FIG. 9, all solder portions (solder feet) 818, 817, 927, 928, 929, 817, 818 of the first and second groups of terminals are arranged in the same row in a lateral direction. In this way, the solder portions (solder feet) 818, 817, 817, 818 of the first group of terminals 811, 812, 813 are aligned with the solder portions (solder feet) 927, 928, 929 of the second group of terminals 920, 281, 923 in a longitudinal direction, therefore, tending to cause crosstalk between the first group of terminals 811, 812, 813 and the second group of terminals 920, 281, 923.

Accordingly, it is desirable to provide an electrical connector which can more effectively reduce the crosstalk between terminals.

SUMMARY

According to an aspect of the invention, there is provided an electrical connector. The electrical connector has an insulative housing, a plurality of first terminals and a plurality of second terminals. The first terminals are disposed in the insulative housing. Each of the first terminals has a first contact portion, a first solder portion, and a first connection portion between the first contact portion and the first solder portion. The plurality of second terminals are also disposed in the insulative housing. Each of the second terminals has a second contact portion, a second solder portion, and a second connection portion between the second contact portion and the second solder portion. The first solder portions of the first terminals and the second solder portions of the second terminals are arranged in two rows in a lateral direction, respectively. The row of the first solder portions is separated from the row of the second solder portions by a predetermined distance in a longitudinal direction.

BRIEF DESCRIPTION OF THE DRAWINGS

The invention will be described with reference to the accompanying figures, of which.

DETAILED DESCRIPTION OF THE EMBODIMENT(S)

Figure 1:
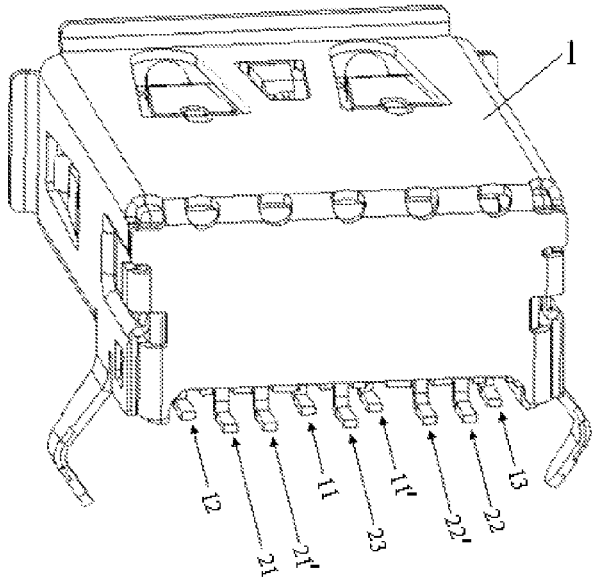
FIG. 1 is a perspective view of an electrical connector according to an illustrative embodiment of the invention.

Illustrative embodiments of the invention will be described hereinafter in detail with reference to the attached drawings, wherein the like reference numerals refer to like elements. The present disclosure may, however, be embodied in many different forms and should not be construed as being limited to the embodiments set forth herein; rather, these embodiments are provided so that the disclosure will be thorough and complete, and will fully convey the concepts of the invention to those skilled in the art.

Figure 2:
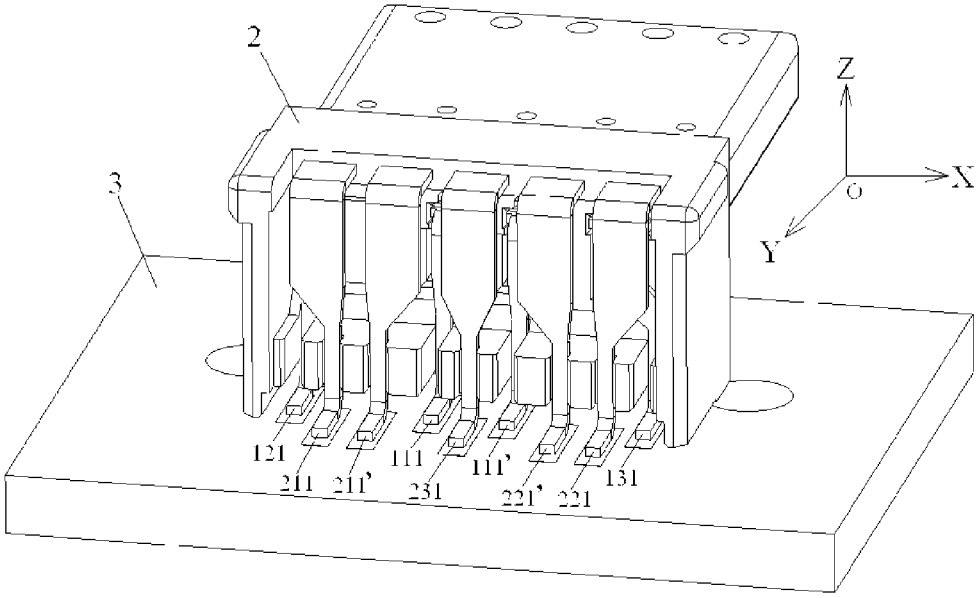
FIG. 2 is a perspective view of the electrical connector shown in FIG. 1 soldered on a PCB, wherein the shield of the electrical connector is removed.

In the illustrative embodiments shown in FIG. 1 and FIG. 2, the electrical connector conforms with, for example, the USB3.0 standard. But the invention is not limited to a USB3.0 connector; it may be any one of other type of electrical connectors.

For the convenience of describing the invention, a reference coordinate system is set forth in FIG. 2. The coordinate axis X denotes a lateral direction of the electrical connector, the coordinate axis Y denotes a longitudinal direction of the electrical connector perpendicular to the lateral direction, and the coordinate axis Z denotes a height direction of the electrical connector perpendicular to the lateral direction and the longitudinal direction.

Referring to FIG. 1 and FIG. 2, the electrical connector mainly comprises an insulative housing 2, a metal shield 1 for enclosing the insulative housing 2, and a plurality of first terminals 11, 11', 12, 13 and a plurality of second terminals 21, 21', 22', 22, 23 held in the insulative housing 2.

As shown in the illustrative embodiment of FIG. 1 and FIG. 2, the plurality of first terminals 11, 11', 12, 13 are used to transmit low speed signals according to USB2.0 communicating protocol, and the plurality of second terminals 21, 21', 22', 22, 23 are used to transmit high speed signals according to USB3.0 communicating protocol.

Referring to FIG. 1 and FIG. 2, in an illustrative embodiment of the invention, the plurality of first terminals comprises a pair of first differential signal terminals 11, 11', a first ground terminal 12, and a common power terminal 13. The plurality of second terminals comprises two pairs of second differential signal terminals 21, 21', 22, 22', and a second ground terminal 23.

Figure 3:
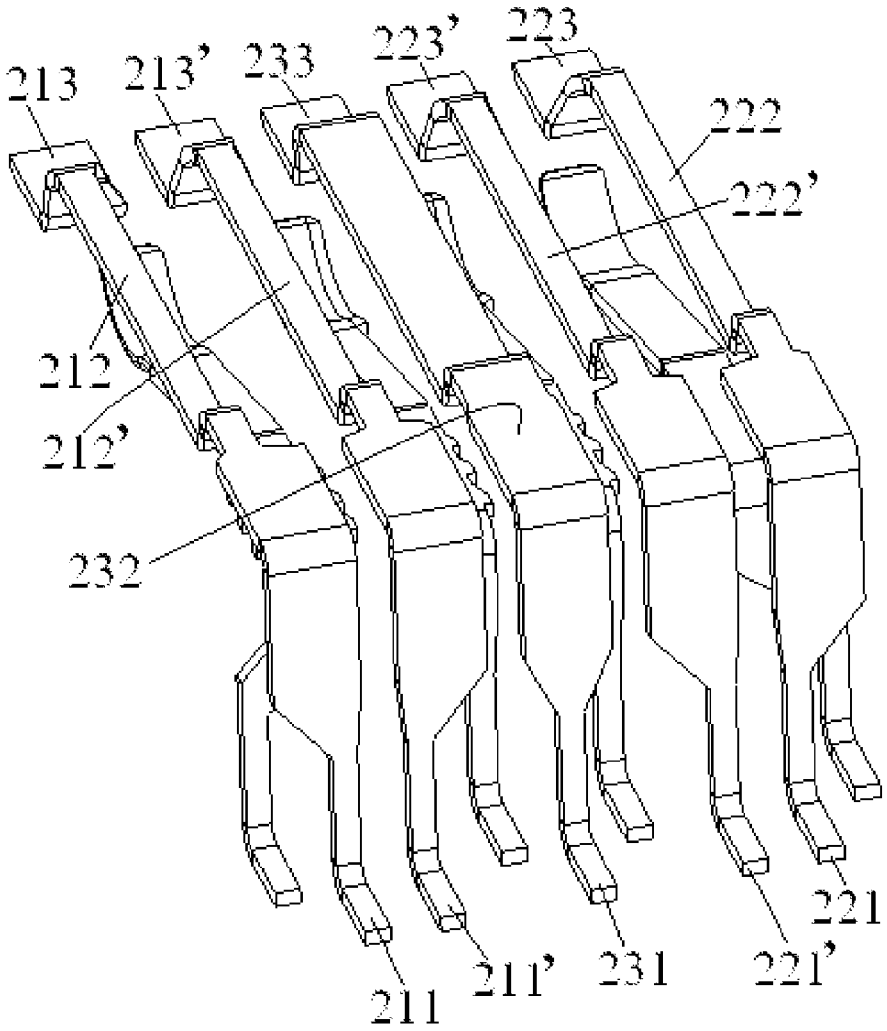
FIG. 3 is a row of second terminals of the electrical connector shown in FIG. 1.
Figure 4:
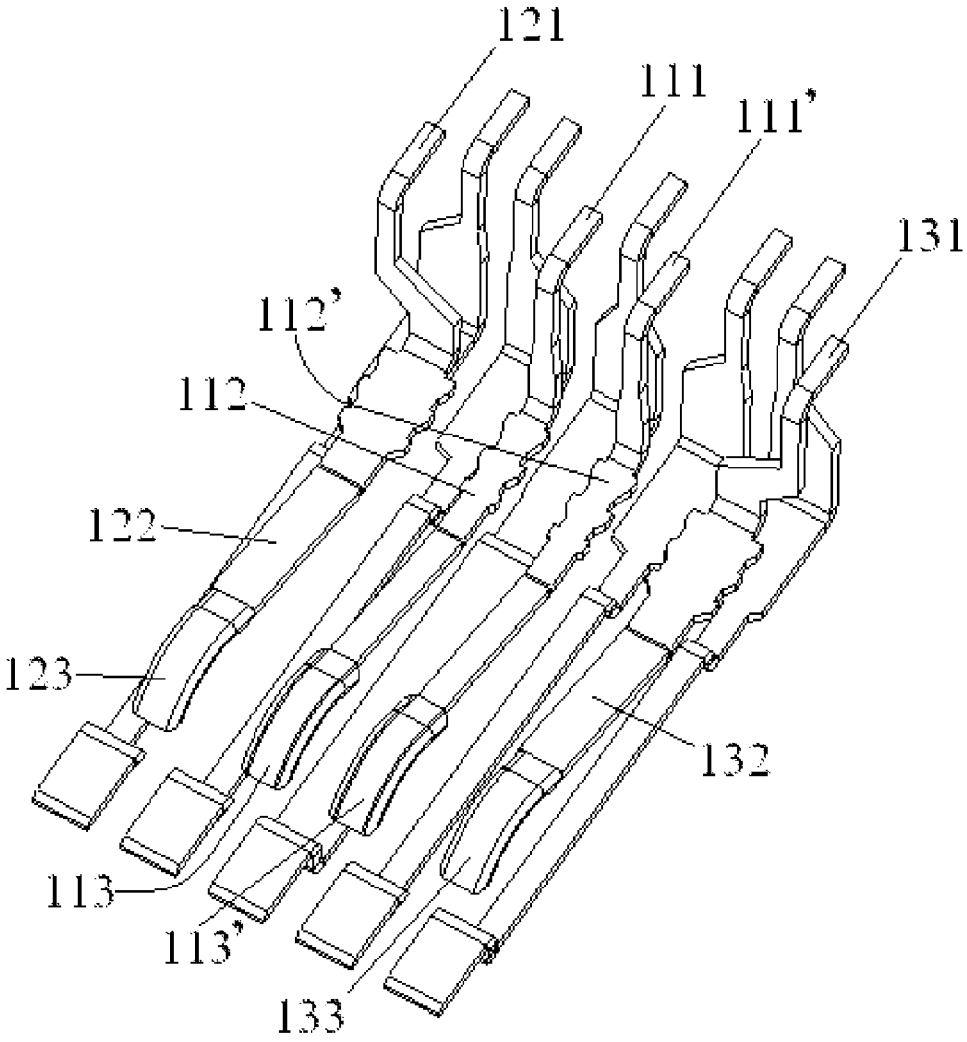
FIG. 4 is a row of first terminals of the electrical connector shown in FIG. 1.

FIG. 3 shows a row of second terminals of the electrical connector shown in FIG. 1; and FIG. 4 shows a row of first terminals of the electrical connector shown in FIG. 1.

As shown in FIG. 3 and FIG. 4, the plurality of first terminals 11, 11', 12, 13 are arranged in a row, and the plurality of second terminals 21, 21', 22', 22, 23 are arranged in the other row above the row of first terminals 11, 11', 12, 13.

As shown in FIG. 1 and FIG. 3, in the row of plurality of second terminals, two pairs of second differential signal terminals 21, 21', 22, 22' are located at both sides of the second ground terminal 23, respectively. Preferably, two pairs of second differential signal terminals 21, 21', 22, 22' are symmetrically arranged at both sides of the second ground terminal 23.

As shown in FIG. 1 and FIG. 4, in the row of first terminals, the pair of first differential signal terminals 11, 11' is located between the first ground terminal 12 and the power terminal 13.

In an illustrative embodiment of the invention, each of the first terminals 11, 11', 12, 13 comprises a first contact portion, a first solder portion for being soldered on a surface of the PCB 3, and a first connection portion between the first contact portion and the first solder portion. More specifically, each of the pair of first differential signal terminals 11, 11' comprises a contact portion 113, 113', a solder portion 111, 111' and a connection portion 112, 112' between the contact portion 113, 113' and the solder portion 111, 111'. Similarly, the first ground terminal 12 comprises a contact portion 123, a solder portion 121, and a connection portion 122 between the contact portion 123 and the solder portion 121. The power terminal 13 comprises a contact portion 133, a solder portion 131, and a connection portion 132 between the contact portion 133 and the solder portion 131.

In an illustrative embodiment of the invention, each of the second terminals 21, 21', 22', 22, 23 comprises a second contact portion, a second solder portion for being soldered on the surface of the PCB 3, and a second connection portion between the second contact portion and the second solder portion. More specifically, referring to FIG. 3, each of one pair of second differential signal terminals 21, 21' comprises a contact portion 213, 213', a solder portion 211, 211' and a connection portion 212, 212' between the contact portion 213, 213' and the solder portion 211, 211'. Similarly, each of the other pair of second differential signal terminals 22, 22' comprises a contact portion 223, 223', a solder portion 221, 221' and a connection portion 222, 222' between the contact portion 223, 223' and the solder portion 221, 221'. The second ground terminal 23 comprises a contact portion 233, a solder portion 231, and a connection portion 232 between the contact portion 233 and the solder portion 231.

As shown in FIGS. 1 to 4, the first solder portions 111, 111', 121, 131 of the first terminals 11, 11', 12, 13 are arranged in a first row in the lateral direction X. The second solder portions 211, 211', 221, 221', 231 of the second terminals 21, 21', 22, 22', 23 are arranged in a second row spaced apart from the first row in the lateral direction X.

In an illustrative embodiment shown in FIGS. 1-4, the row of second solder portions 211, 211', 221, 221', 231 is located in front of the row of first solder portions 111, 111', 121, 131.

Figure 8:
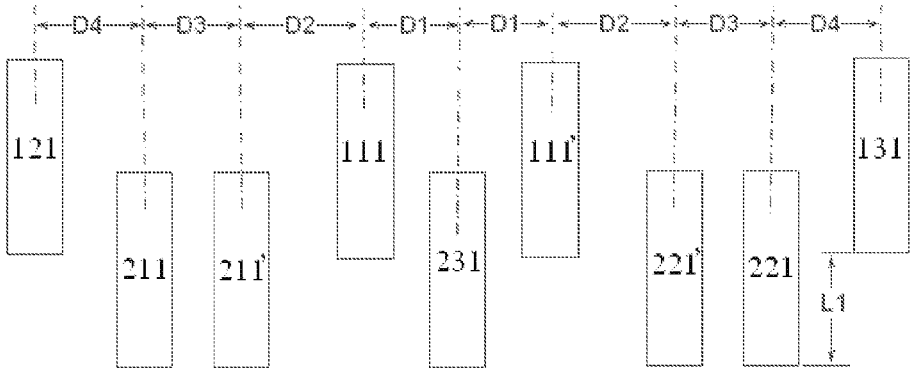
FIG. 8 shows the footprints of the solder portions of the electrical connector soldered on the PCB shown in FIG. 2.
Figure 9:
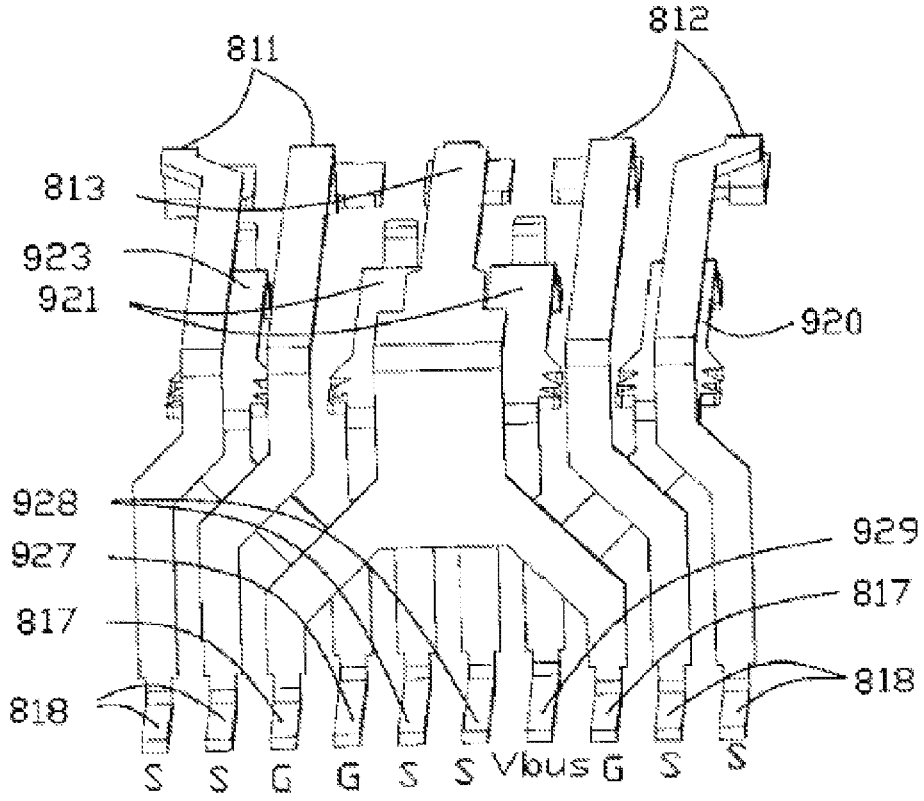
Fig. 9 PRIOR ART
FIG. 9 is a conventional electrical connector.

In this way, as shown in FIGS. 1-4, the row of first solder portions 111, 111', 121, 131 is separated from the row of second solder portions 211, 211', 221, 221', 231 by a predetermined distance L1 (as shown in FIG. 8) in the longitudinal direction Y, instead of being arranged in the same row without any space in the longitudinal direction Y. Accordingly, the space distance between the row of first solder portions 111, 111', 121, 131 and the row of second solder portions 211, 211', 221, 221', 231 is increased in the longitudinal direction Y, and it can effectively reduce the crosstalk between the row of first terminals and the row of second terminals.

In an illustrative embodiment shown in FIGS. 1-4, each of the first solder portions 111, 111', 121, 131 and each of the second solder portions 211, 211', 221, 221', 231 are substantively the same with each other in size and in shape. In addition, the first solder portions 111, 111', 121, 131 and the second solder portions 211, 211', 221, 221', 231 are in the same plane parallel to the surface of the PCB 3. In this way, the first solder portions 111, 111', 121, 131 and the second solder portions 211, 211', 221, 221', 231 may be soldered on the surface of the PCB 3 in a SMT (Surface Mounted Technology) manner.

In an illustrative embodiment, as shown in FIGS. 1-4, the first solder portions 111, 111', 121, 131 and the second solder portions 211, 211', 221, 221', 231 each has a rectangular shape. But it should be noted that the invention is not limited to this, the first solder portions 111, 111', 121, 131 and the second solder portions 211, 211', 221, 221', 231 may have any other suitable shapes, such as a circle shape, a square shape or an oval shape.

Referring to FIGS. 1-4, in an illustrative embodiment, front ends of the first solder portions 111, 111', 121, 131 are laid in the same longitudinal line as back ends of the second solder portions 211, 211', 221, 221', 231. But the invention is not limited to this, the front ends of the first solder portions 111, 111', 121, 131 and the back ends of the second solder portions 211, 211', 221, 221', 231 may be laid in two different longitudinal lines, instead of a same longitudinal line.

Referring to FIGS. 1-4, in the row of first solder portions 111, 111', 121, 131, the solder portion 121 of the first ground terminal 12 is located at one outermost side in the lateral direction X, and the solder portion 131 of the power terminal 13 is located at the other outermost side in the lateral direction X.

As shown in FIGS. 1-4, the solder portion 231 of the second ground terminal 23 is located between the solder portions 111, 111' of the pair of first differential signal terminals 11, 11' in the lateral direction X. The solder portions 211, 211' of the one pair of second differential signal terminals 21, 21' are located between the solder portion 121 of the first ground terminal 12 and the solder portion 111 of the first differential signal terminal 11 in the lateral direction X. The solder portions 221, 221' of the other pair of second differential signal terminals 22, 22' are located between the solder portion 131 of the power terminal 13 and the solder portion 111' of the other first differential signal terminal 11' in the lateral direction X.

As shown in FIGS. 1-4, the solder portions 121, 211, 211', 111 and the solder portions 131, 221, 221', 111' are symmetrically arranged at both sides of the solder portion 231.

Figure 5:
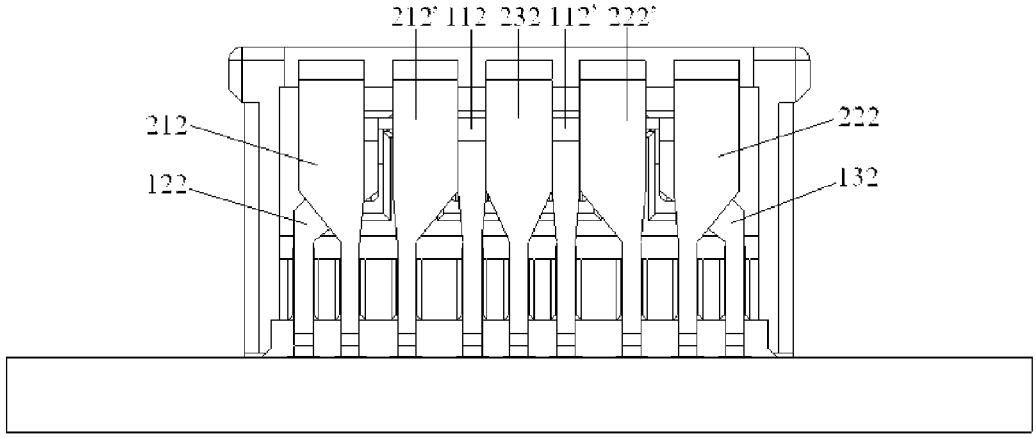
FIG. 5 is a rear view of the electrical connector of FIG. 2 soldered on the PCB.
Figure 6:
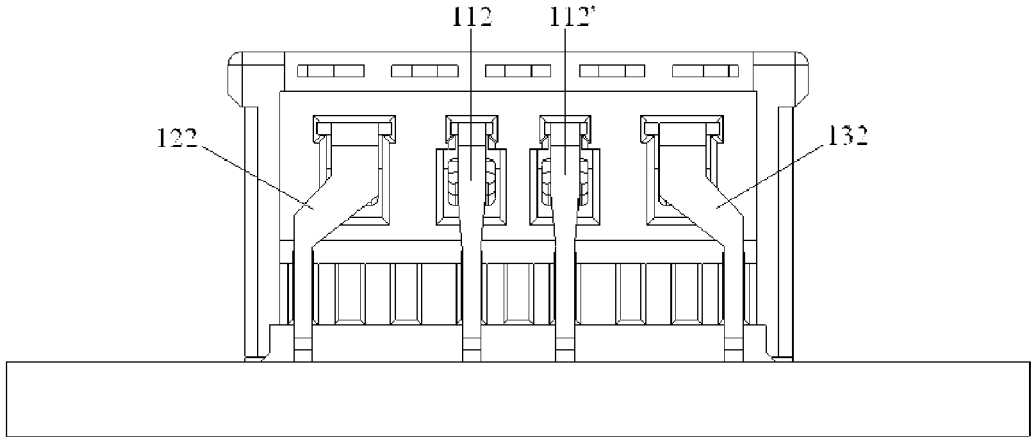
FIG. 6 is a rear view of the electrical connector of FIG. 2 soldered on the PCB, wherein the plurality of second terminals are removed and only the plurality of first terminals are shown.
Figure 7:
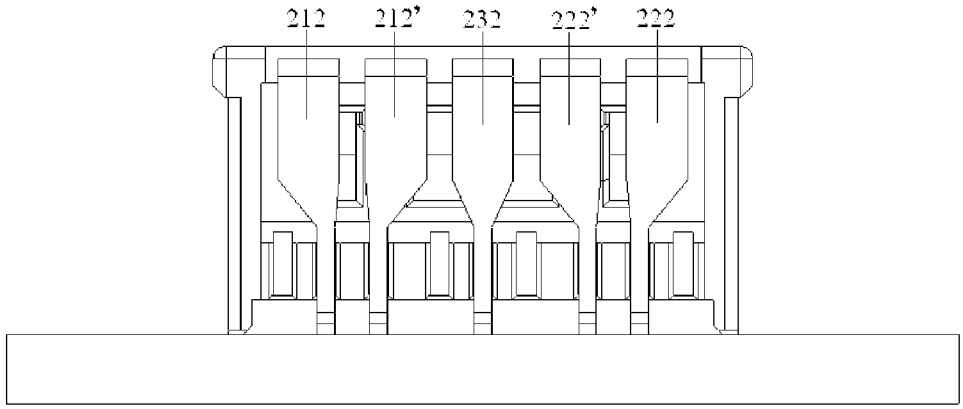
FIG. 7 is another rear view of the electrical connector soldered on the PCB shown in FIG. 2, wherein the plurality of first terminals are removed and only the plurality of second terminals are shown.

As shown in FIGS. 5-7, a part of the connection portion 122 of the first ground terminal 12 is laterally offset from a part of the connection portion 212 of one terminal 21 at outer side of one pair of second differential signal terminals 21, 21'. In this way, the distance between the first ground terminal 12 and the second differential signal terminal 21 can be increased in the lateral direction X, and it further reduces the crosstalk therebetween.

As shown in FIGS. 5-7, a part of the connection portion 132 of the power terminal 13 is laterally offset from a part of the connection portion 222 of one terminal 22 at outer side of the other pair of second differential signal terminals 22, 22'. In this way, the space distance between the power terminal 13 and the second differential signal terminal 22 can be increased in the lateral direction X, and it further reduces the crosstalk therebetween.

A part of the connection portion 212' of one terminal 21' at inner side of the one pair of second differential signal terminals 21, 21' is laterally offset from one terminal 11 of the pair of first differential signal terminals 11, 11'. In this way, the space distance between the second differential signal terminal 21' and the first differential signal terminal 11 can be increased in the lateral direction X, and it further reduces the crosstalk therebetween.

A part of the connection portion 222' of the other terminal 22' at the inner side of the other pair of the second differential signal terminals 22, 22' is laterally offset from the other terminal 11' of the pair of first differential signal terminals 11, 11'. In this way, the distance between the second differential signal terminal 22' and the other first differential signal terminal 11' can be increased in the lateral direction X, to further reduce the crosstalk therebetween.

Furthermore, the connection portion 122 of the first ground terminal 12 crosses the connection portion 212 of one terminal 21 at outer side of the one pair of the second differential signal terminals 21, 21'. In this way, the overlapping area between the connection portion 122 and the connection portion 212 is reduced, and the crosstalk between the first ground terminal 12 and the second differential signal terminal 21 is reduced accordingly.

Similarly, the connection portion 132 of the power terminal 13 crosses the connection portion 222 of one terminal 22 at outer side of the other pair of second differential signal terminals 22, 22'. In this way, the overlapping area between the connection portion 132 and the connection portion 222 is reduced, and the crosstalk between the power terminal 13 and the second differential signal terminal 22 is reduced accordingly.

As shown in FIGS. 1-7, in all terminals of the electrical connector, the second ground terminal 23 and the pair of first differential signal terminals 11, 11' each has a substantively symmetrical shape, and the other terminals 12, 13, 21, 21' 22, 22' each has an offsetting part and is not symmetrical in shape.

As shown in FIG. 8, front ends of the row of the first solder portions (footprints) 121, 111, 111', 131 is separated from front ends of the row of the second solder portions (footprints) 211, 211', 231, 221, 221' by a distance L1 of about 1.5 mm in the longitudinal direction Y. A longitudinal center line of each of the solder portions 111, 111' of the first differential signal terminals 11, 11' is separated from a longitudinal center line of the solder portion 231 of the second ground terminal 23 by a distance D1 in the lateral direction X.

A longitudinal center line of the solder portion 211' of one terminal 21' at inner side of the one pair of second differential signal terminals 21, 21' is separated from a longitudinal center line of the solder portion 111 of the one first differential signal terminal 11 by a distance D2 in the lateral direction X, and a longitudinal center line of the solder portion 221' of one terminal 22' at inner side of the other pair of second differential signal terminals 22, 22' is also separated from a longitudinal center line of the solder portion 111' of the other first differential signal terminal 11' by a distance D2 in the lateral direction X.

As shown in FIG. 8, a longitudinal center line of the solder portion 211 of one terminal 21 at outer side of the one pair of second differential signal terminals 21, 21' is separated from the longitudinal center line of the solder portion 211' of one terminal 21' at inner side of the one pair of second differential signal terminals 21, 21' by a distance D3 in the lateral direction X and a longitudinal center line of the solder portion 221 of one terminal 22 at the outer side of the other pair of second differential signal terminals 22, 22' is also separated from the longitudinal center line of the solder portion 221' of one terminal 22' at inner side of the other pair of second differential signal terminals 22, 22' by a distance D3 in the lateral direction X.

As shown in FIG. 8, a longitudinal center line of the solder portion 121 of the first ground terminal 12 is separated from the longitudinal center line of the solder portion 211 of one terminal 21 at outer side of the one pair of second differential signal terminals 21, 21' by a distance D4 in the lateral direction X, and a longitudinal center line of the solder portion 131 of the power terminal 13 is also separated from the longitudinal center line of the solder portion 221 of one terminal 22 at outer side of the other pair of second differential signal terminals 22, 22' by a distance D4 in the lateral direction X.

In an illustrative embodiment of the invention, the distances D1, D2, D3, D4 satisfy the following expression (1):

$$D1=D4<D3<D2 \quad (1).$$

For example, the distances D1, D2, D3 and D4 may be equal to about 1.0 mm, 1.4 mm, 1.2 mm and 1.0 mm, respectively.

In the various illustrative embodiments of the invention described, the solder portions of the plurality of first terminals and the solder portions of the plurality of second terminals are arranged in two rows being separated from each other by a predetermined distance in the longitudinal direction, instead of being arranged in the same row without any space in the longitudinal direction. Accordingly, the spacing distance between the row of solder portions of the first terminals and the row of solder portions of the second terminals is increased, and the crosstalk and interference there between is advantageously reduced accordingly.

Although several illustrative embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector, comprising:

an insulative housing;

a plurality of first terminals disposed in the insulative housing, each of the first terminals comprising a first contact portion, a first solder portion, and a first connection portion between the first contact portion and the first solder portion; and a plurality of second terminals disposed in the insulative housing, each of the second terminals comprising a second contact portion, a second solder portion, and a second connection portion between the second contact portion and the second solder portion, wherein the first solder portions of the first terminals and the second solder portions of the second terminals are arranged in two rows in a lateral direction, respectively; and wherein the row of the first solder portions is separated from the row of the second solder portions by a predetermined distance along a longitudinal direction:

wherein a part of the first connection portion of one of the plurality of first terminals is laterally offset from a part of the second connection portion of one of the plurality of second terminals.

2. The electrical connector according to claim 1, wherein the predetermined distance is equal to about 1.5 mm.

3. The electrical connector according to claim 1, wherein the plurality of first terminals comprises a pair of first differential signal terminals, a first ground terminal, and a power terminal; and wherein the plurality of second terminals comprises two pairs of second differential signal terminals, and a second ground terminal.

4. The electrical connector according to claim 3, wherein the plurality of first terminals are arranged in a row, and the pair of first differential signal terminals is located between the first ground terminal and the power terminal;

wherein the plurality of second terminals are arranged in the other row, and the second ground terminal is located between the two pairs of second differential signal terminals.

5. The electrical connector according to claim 4, wherein a part of the first connection portion of the first ground terminal is laterally offset from a part of the second connection portion of one of the terminals at an outer side of one pair of second differential signal terminals.

6. The electrical connector according to claim 5, wherein a part of the first connection portion of the power terminal is laterally offset from a part of the second connection portion of one of the terminals at an outer side of the other pair of second differential signal terminals.

7. The electrical connector according to claim 6, wherein a part of the second connection portion of one of the terminals at an inner side of the one pair of second differential signal terminals is laterally offset from one terminal of the pair of first differential signal terminals; and wherein a part of the second connection portion of the other terminal at an inner side of the other pair of second differential signal terminals is laterally offset from the other terminal of the pair of first differential signal terminals.

8. The electrical connector according to claim 6, wherein the first connection portion of the first ground terminal crosses the second connection portion of one terminal at the outer side of the one pair of second differential signal terminals; and wherein the first connection portion of the power terminal crosses the second connection portion of one terminal at the outer side of the other pair of second differential signal terminals.

9. The electrical connector according to claim 8, wherein the first solder portion of the first ground terminal is located at an outermost side in the lateral direction, and the first solder portion of the power terminal is located at the other outermost side in the lateral direction; and wherein the second solder portion of the second ground terminal is located between the first solder portions of the pair of first differential signal terminals in the lateral direction.

10. The electrical connector according to claim 9, wherein the second solder portions of the one pair of second differential signal terminals are located between the first solder portion of the first ground terminal and the first solder portion of the first differential signal terminal in the lateral direction; and wherein the second solder portions of the other pair of second differential signal terminals are located between the first solder portion of the power terminal and the first solder portion of the other first differential signal terminal in the lateral direction.

11. The electrical connector according to claim 10, wherein the second ground terminal and the pair of first differential signal terminals each has a substantively symmetrical shape.

12. The electrical connector according to claim 11, wherein front ends of the row of the first solder portions are separated from front ends of the row of the second solder portions by a distance of 1.5 mm in the longitudinal direction.

13. The electrical connector according to claim 12, wherein a center of each of the first solder portions of the first differential signal terminals is separated from a center of the second solder portion of the second ground terminal by a distance of about 1.0 mm in the lateral direction (X).

14. The electrical connector according to claim 13, wherein a center of the second solder portion of one terminal at the inner side of the one pair of second differential signal terminals is separated from a center of the first solder portion of the one first differential signal terminal by a distance of about 1.4 mm in the lateral direction; and wherein a center of the second solder portion of one terminal at inner side of the other pair of second differential signal terminals is separated from a center of the second solder portion of the other first differential signal terminal by a distance of about 1.4 mm in the lateral direction.

15. The electrical connector according to claim 14, wherein a center of the second solder portion of one terminal at the outer side of the one pair of second differential signal terminals is separated from the center of the second solder portion of one terminal at the inner side of the one pair of second differential signal terminals by a distance of about 1.2 mm in the lateral direction; and wherein a center of the second solder portion of one terminal at the outer side of the other pair of second differential signal terminals is separated from the center of the second solder portion of one terminal at the inner side of the other pair of second differential signal terminals by a distance of about 1.2 mm in the lateral direction.

16. The electrical connector according to claim 15, wherein a center of the first solder portion of the first ground terminal is separated from the center of the second solder portion of one terminal at the outer side of the one pair of second differential signal terminals by a distance of about 1.0 mm in the lateral direction; and wherein a center of the first solder portion of the power terminal is separated from the center of the second solder portion of one terminal at the outer side of the other pair of second differential signal terminals by a distance of about 1.0 mm in the lateral direction.

17. An electrical connector, comprising:

an insulative housing;

a plurality of first terminals disposed in the insulative housing, each of the first terminals comprising a first contact portion, a first solder portion, and a first connection portion between the first contact portion and the first solder portion, the plurality of first terminals comprises a pair of first differential signal terminals, a first ground terminal, and a power terminal; and a plurality of second terminals disposed in the insulative housing, each of the second terminals comprising a second contact portion, a second solder portion, and a second connection portion between the second contact portion and the second solder portion, the plurality of second terminals comprises two pairs of second differential signal terminals, and a second ground terminal;

wherein the first solder portions of the first terminals and the second solder portions of the second terminals are arranged in two rows in a lateral direction, respectively; and wherein the row of the first solder portions is separated from the row of the second solder portions by a predetermined distance along a longitudinal direction, the predetermined distance is equal to about 1.5 mm;

wherein the plurality of first terminals are arranged in a row, and the pair of first differential signal terminals is located between the first ground terminal and the power terminal;

wherein the plurality of second terminals are arranged in the other row, and the second ground terminal is located between the two pairs of second differential signal terminals;

wherein a part of the first connection portion of the first ground terminal is laterally offset from a part of the second connection portion of one of the terminals at an outer side of one pair of second differential signal terminals.

18. The electrical connector according to claim 17, wherein a part of the first connection portion of the power terminal is laterally offset from a part of the second connection portion of one of the terminals at an outer side of the other pair of second differential signal terminals.

19. The electrical connector according to claim 18, wherein a part of the second connection portion of one of the terminals at an inner side of the one pair of second differential signal terminals is laterally offset from one terminal of the pair of first differential signal terminals; and wherein a part of the second connection portion of the other terminal at an inner side of the other pair of second differential signal terminals is laterally offset from the other terminal of the pair of first differential signal terminals.

20. The electrical connector according to claim 18, wherein the first connection portion of the first ground terminal crosses the second connection portion of one terminal at the outer side of the one pair of second differential signal terminals; and wherein the first connection portion of the power terminal crosses the second connection portion of one terminal at the outer side of the other pair of second differential signal terminals.

21. The electrical connector according to claim 20, wherein the first solder portion of the first ground terminal is located at an outermost side in the lateral direction, and the first solder portion of the power terminal is located at the other outermost side in the lateral direction; and wherein the second solder portion of the second ground terminal is located between the first solder portions of the pair of first differential signal terminals in the lateral direction.

22. The electrical connector according to claim 21, wherein the second solder portions of the one pair of second differential signal terminals are located between the first solder portion of the first ground terminal and the first solder portion of the first differential signal terminal in the lateral direction; and wherein the second solder portions of the other pair of second differential signal terminals are located between the first solder portion of the power terminal and the first solder portion of the other first differential signal terminal in the lateral direction.

23. The electrical connector according to claim 22, wherein the second ground terminal and the pair of first differential signal terminals each has a substantively symmetrical shape.

24. The electrical connector according to claim 23, wherein front ends of the row of the first solder portions are separated from front ends of the row of the second solder portions by a distance of 1.5 mm in the longitudinal direction.

25. The electrical connector according to claim 24, wherein a center of each of the first solder portions of the first differential signal terminals is separated from a center of the second solder portion of the second ground terminal by a distance of about 1.0 mm in the lateral direction (X).

26. The electrical connector according to claim 25, wherein a center of the second solder portion of one terminal at the inner side of the one pair of second differential signal terminals is separated from a center of the first solder portion of the one first differential signal terminal by a distance of about 1.4 mm in the lateral direction; and wherein a center of the second solder portion of one terminal at inner side of the other pair of second differential signal terminals is separated from a center of the second solder portion of the other first differential signal terminal by a distance of about 1.4 mm in the lateral direction.

27. The electrical connector according to claim 26, wherein a center of the second solder portion of one terminal at the outer side of the one pair of second differential signal terminals is separated from the center of the second solder portion of one terminal at the inner side of the one pair of second differential signal terminals by a distance of about 1.2 mm in the lateral direction; and wherein a center of the second solder portion of one terminal at the outer side of the other pair of second differential signal terminals is separated from the center of the second solder portion of one terminal at the inner side of the other pair of second differential signal terminals by a distance of about 1.2 mm in the lateral direction.

28. The electrical connector according to claim 27, wherein a center of the first solder portion of the first ground terminal is separated from the center of the second solder portion of one terminal at the outer side of the one pair of second differential signal terminals by a distance of about 1.0 mm in the lateral direction; and wherein a center of the first solder portion of the power terminal is separated from the center of the second solder portion of one terminal at the outer side of the other pair of second differential signal terminals by a distance of about 1.0 mm in the lateral direction.

* * * * *